US006389833B1

(12) United States Patent
Bouloy

(10) Patent No.: US 6,389,833 B1
(45) Date of Patent: May 21, 2002

(54) EVAPORATOR HAVING DEFROSTING CAPABILITIES

(76) Inventor: Jose B. Bouloy, 519 SE. Euclid La., Port St. Lucie, FL (US) 34983

( * ) Notice: Subject to any disclaimer, the term of this patent is extended or adjusted under 35 U.S.C. 154(b) by 0 days.

(21) Appl. No.: 09/630,908

(22) Filed: Aug. 2, 2000

Related U.S. Application Data

(60) Provisional application No. 60/062,800, filed on Oct. 24, 1997.

(51) Int. Cl.[7] ..... F25B 47/00
(52) U.S. Cl. ..... 62/277; 62/276; 62/275
(58) Field of Search ..... 62/275, 276, 277

(56) References Cited

U.S. PATENT DOCUMENTS 3,675,438 A * 7/1972 Takemasa et al. ..... 62/156
3,677,025 A * 7/1972 Payne ..... 62/81
4,019,341 A * 4/1977 Iwasaki ..... 62/277
4,087,987 A * 5/1978 Schumacher et al. ..... 62/276
4,199,957 A * 4/1980 Richardson et al. ..... 62/275
4,254,822 A * 3/1981 Geier ..... 165/48
5,921,092 A * 7/1999 Behr et al. ..... 62/81
6,094,925 A * 8/2000 Arshansky et al. ..... 62/81

* cited by examiner

*Primary Examiner*—William Doerrler
*Assistant Examiner*—Mark Shulman

(57) ABSTRACT

An evaporator having defrosting capabilities for space-saving and hard-to-reach installations and for connecting to a condensing unit with a condensing coil and a compressor. The evaporator includes a center tube, a middle tube, and an outer tube. The center tube has a refrigerant inlet for supplying a refrigerant before being evaporated, and conducting the refrigerant in a first direction opposite to the refrigerant inlet of the center tube. The middle tube concentrically receives the center tube and defines a first passage therebetween for conducting a hot injected gas for performing a mild, but positive, defrost of the evaporator as the evaporator continues to operate. The outer tube has a length and an end opposite to the refrigerant inlet of the center tube and concentrically receives the middle tube and defines a second passage therebetween for conducting the refrigerant after evaporation in a second direction opposite to the first direction and along the length of the outer tube and thereby allowing for heat transfer along the length of the outer tube.

16 Claims, 1 Drawing Sheet

EVAPORATOR HAVING DEFROSTING CAPABILITIES

CROSS REFERENCE TO RELATED APPLICATIONS

The instant application is the formal filing for the provisional application, Ser. No.: 60/062,800, filed Oct. 24, 1997.

BACKGROUND OF THE INVENTION

1. Field of the Invention

The present invention relates to an evaporator. More particularly, the present invention relates to an evaporator having defrosting capabilities.

2. Description of the Prior Art

Numerous innovations for evaporators have been provided in the prior art that will be described. Even though these innovations may be suitable for the specific individual purposes to which they address, however, they differ from the present invention in that they do not teach an evaporator having defrosting capabilities.

Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide an evaporator having defrosting capabilities that avoids the disadvantages of the prior art.

ANOTHER OBJECT of the present invention is to provide an evaporator having defrosting capabilities that is simple and inexpensive to manufacture.

STILL ANOTHER OBJECT of the present invention is to provide an evaporator having defrosting capabilities that is simple to use.

BRIEFLY STATED, YET ANOTHER OBJECT of the present invention is to provide an evaporator having defrosting capabilities for space-saving and hard-to-reach installations and for connecting to a condensing unit with a condensing coil and a compressor. The evaporator includes a center tube, a middle tube, and an outer tube. The center tube has a refrigerant inlet for supplying a refrigerant before being evaporated, and conducting the refrigerant in a first direction opposite to the refrigerant inlet of the center tube. The middle tube concentrically receives the center tube and defines a first passage therebetween for conducting a hot injected gas for performing a mild, but positive, defrost of the evaporator as the evaporator continues to operate. The outer tube has a length and an end opposite to the refrigerant inlet of the center tube and concentrically receives the middle tube and defines a second passage therebetween for conducting the refrigerant after evaporation in a second direction opposite to the first direction and along the length of the outer tube and thereby allowing for heat transfer along the length of the outer tube.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
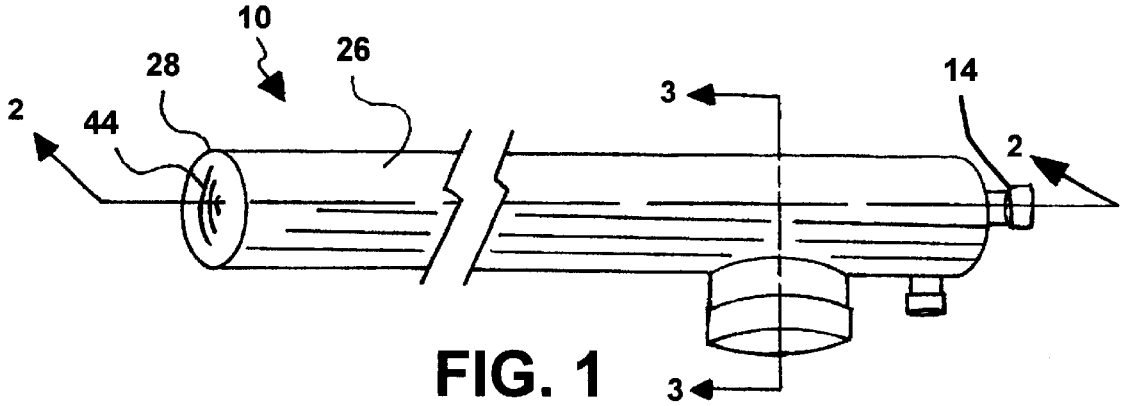
FIG. 1 is a diagrammatic perspective view of the present invention.

| | |
|---|---|
| 10 | evaporator with defrosting capabilities of the present invention |
| 12 | center tube |
| 14 | refrigerant inlet of center tube 12 for supplying refrigerant 16 before being evaporated |
| 16 | refrigerant |
| 18 | first direction of flow of refrigerant 16 |
| 20 | middle tube |
| 22 | first passage for conducting hot injected gas 24 for performing a mild, but positive, defrost of evaporator 10 as evaporator 10 continues to operate |
| 24 | hot injected gas |
| 26 | outer tube |
| 28 | end of outer tube 26 |
| 29 | second passage for conducting refrigerant 16 after evaporation in second direction |
| 30 | second direction of flow of refrigerant 16 |
| 32 | open ends of center tube 12 |
| 34 | open ends of middle tube 20 |
| 36 | hot gas inlet |
| 38 | solenoid valve for being in fluid communication between compressor and condensing coil of condensing unit and for supplying hot injected gas 24 |
| 40 | control for turning off condensing unit at either a predetermined pressure or a predetermined temperature |
| 42 | metering device for allowing refrigerant to flow through center tube 12 |
| 44 | end cap of outer tube 26 |
| 46 | refrigerant outlet for returning refrigerant 16 to compressor for recirculation. |

DETAILED DESCRIPTION OF THE PREFERRED EMBODIMENT

Figure 2:
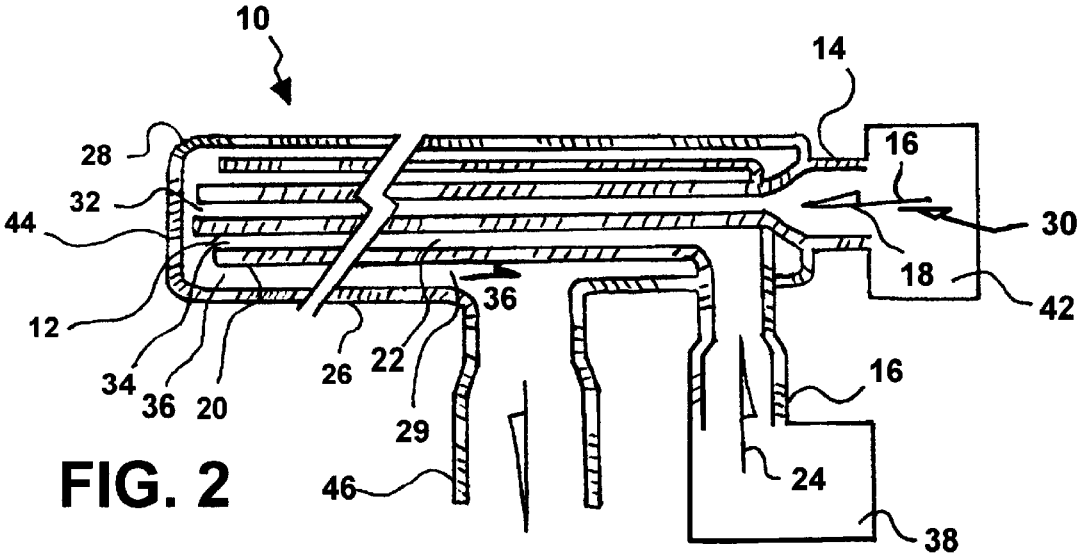
FIG. 2 is an enlarged diagrammatic cross sectional view taken on LINE 2—2 in FIG. 1.
Figure 3:
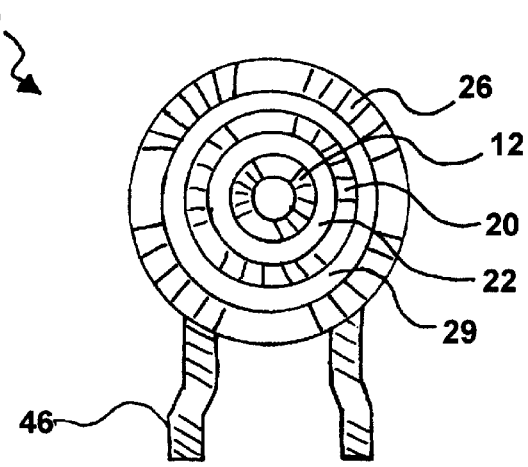
FIG. 3 is an enlarged diagrammatic cross sectional view taken on LINE 3—3 in FIG. 1.

Referring now to the figures, in which like numerals indicate like parts, and particularly to FIGS. 1–3, which are, respectively, a diagrammatic perspective view of the present invention, an enlarged diagrammatic cross sectional view taken on LINE 2—2 in FIG. 1, and an enlarged diagrammatic cross sectional view taken on LINE 3—3 in FIG. 1, the evaporator with defrosting capabilities of the present invention is shown generally at 10 for space-saving and hard-to-reach installations and for connecting to a condensing unit (not shown) with a condensing coil (not shown) and a compressor (not shown).

The evaporator with defrosting capabilities 10 comprises a center tube 12 having a refrigerant inlet 14 for supplying a refrigerant 16 before being evaporated, and conducting the refrigerant 16 in a first direction 18 opposite to the refrigerant inlet 14 of the center tube 12.

The evaporator with defrosting capabilities 10 further comprises a middle tube 20 concentrically receiving the center tube 12 and defining a first passage 22 therebetween for conducting a hot injected gas 24 for performing a mild, but positive, defrost of the evaporator 10 as the evaporator 10 continues to operate.

The evaporator with defrosting capabilities 10 further comprises an outer tube 26 having a length and an end 28 opposite to the refrigerant inlet 14 of the center tube 12 and concentrically receiving the middle tube 20 and defining a second passage 29 therebetween for conducting the refrigerant 16 after evaporation in a second direction 30 opposite to the first direction 18 and along the length of the outer tube 26 and thereby allowing for heat transfer along the length of the outer tube 26.

The outer tube 26 concentrically receiving the middle tube 20 allows for minimal amount of the refrigerant 16 to be used in the heat transfer.

The defrost has a temperature in a range no greater than approximately 35 to approximately 40 degrees and can be intermittent.

The center tube 12 has open ends 32 and the middle tube 20 has open ends 34.

The evaporator having defrosting capabilities 10 further comprises a hot gas inlet 36 extending perpendicularly from, and in fluid communication with the middle tube 20.

The evaporator having defrosting capabilities 10 further comprises a solenoid valve 38 for being in fluid communication between the compressor (not shown) and the condensing coil (not shown) of the condensing unit (not shown) and for supplying the hot injected gas 24.

The outer tube 26 is for connecting to the condensing unit (not shown) for recirculating the refrigerant 16 until the heat transfer is completed.

The center tube 12, the middle tube 20, and the outer tube 26 can be either metal or plastic, and are cylindrically-shaped and elongated.

The evaporator having defrosting capabilities 10 further comprises a control 40 for turning off the condensing unit (not shown) at either a predetermined pressure or a predetermined temperature.

The evaporator having defrosting capabilities 10 further comprises a metering device 42 disposed at the refrigerant inlet 14 of the center tube 12 for allowing the refrigerant 16 to flow through the center tube 12.

The evaporator having defrosting capabilities 10 further comprises an end cap 44 disposed at, and sealing, the end 28 of the outer tube 26.

The evaporator having defrosting capabilities 10 further comprises a refrigerant outlet 46 extending perpendicularly from, and in fluid communication with, the outer tube 26 for returning the refrigerant 16 to the compressor (not shown) for recirculation.

It will be understood that each of the elements described above, or two or more together, may also find a useful application in other types of constructions-differing from the types described above.

While the invention has been illustrated and described as embodied in an evaporator with defrosting capabilities, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An evaporator having defrosting capabilities for space-saving and hard-to-reach installations and for connecting to a condensing unit with a condensing coil and a compressor, said evaporator comprising:

a) a center tube having a refrigerant inlet for supplying a refrigerant before being evaporated, and conducting the refrigerant in a first direction opposite to said refrigerant inlet of said center tube;

b) a middle tube concentrically receiving said center tube and defining a first passage therebetween for conducting a hot injected gas for performing a mild, but positive, defrost of said evaporator as said evaporator continues to operate; and c) an outer tube having a length and an end opposite to said refrigerant inlet of said center tube and concentrically receiving said middle tube and defining a second passage therebetween for conducting the refrigerant after evaporation in a second direction opposite to the first direction and along said length of said outer tube and thereby allowing for heat transfer along said length of said outer tube;

wherein said outer tube concentrically receiving said middle tube allows for minimal amount of the refrigerant to be used in the heat transfer.

2. The evaporator as defined in claim 1, wherein said center tube has open ends.

3. The evaporator as defined in claim 1, wherein said middle tube has open ends.

4. The evaporator as defined in claim 1; further comprising a hot gas inlet extending perpendicularly from, and in fluid communication with said middle tube.

5. The evaporator as defined in claim 1, wherein said defrost is intermittent.

6. The evaporator as defined in claim 1; further comprising a solenoid valve for being in fluid communication between the compressor and the condensing coil of the condensing unit and for supplying the hot injected gas.

7. The evaporator as defined in claim 1, wherein said defrost has a temperature in a range no greater than approximately 35 to approximately 40 degrees.

8. The evaporator as defined in claim 1, wherein said outer tube is for connecting to the condensing unit for recirculating the refrigerant until the heat transfer is completed.

9. The evaporator as defined in claim 1, wherein said center tube, said middle tube, and said outer tube are metal.

10. The evaporator as defined in claim 1, wherein said center tube, said middle tube, and said outer tube are plastic.

11. The evaporator as defined in claim 1, wherein each of said center tube, said middle tube, and said outer tube is cylindrically-shaped and elongated.

12. The evaporator as defined in claim 1; further comprising a control for turning off the condensing unit at a predetermined pressure.

13. The evaporator as defined in claim 1; further comprising a control for turning off the condensing unit at a predetermined temperature.

14. The evaporator as defined in claim 1; further comprising a metering device disposed at said refrigerant inlet of said center tube for allowing the refrigerant to flow through said center tube.

15. The evaporator as defined in claim 1; further comprising an end cap disposed at, and sealing, said end of said outer tube.

16. The evaporator as defined in claim 1; further comprising a refrigerant outlet extending perpendicularly from, and in fluid communication with, said outer tube for returning the refrigerant to the compressor for recirculation.

* * * * *